United States Patent [19]

Culpepper

[11] 4,084,693

[45] Apr. 18, 1978

[54] ARTICLE CARRIER

[75] Inventor: Will Lester Culpepper, Tucker, Ga.

[73] Assignee: The Mead Corporation, Dayton, Ohio

[21] Appl. No.: 683,192

[22] Filed: May 4, 1976

[51] Int. Cl.[2] ..... B65D 5/48

[52] U.S. Cl. ..... 206/427; 229/28 BC; 229/40

[58] Field of Search ..... 229/40, 29 E, 29 B, 229/29 C, 28 BC; 206/196, 434, 176–179, 193, 156, 427, 433

[56] References Cited

U.S. PATENT DOCUMENTS

| | | | |
|---|---|---|---|
| 1,668,549 | 5/1928 | Brown | 229/29 E |
| 2,134,763 | 11/1938 | Lawless | 229/29 E |
| 3,715,029 | 2/1973 | Wood | 206/196 |
| 3,937,391 | 2/1976 | Focke | 229/29 E |

*Primary Examiner*—Stephen P. Garbe
*Attorney, Agent, or Firm*—Walter M. Rodgers; Walter A. Rodgers

[57] ABSTRACT

A wraparound type carrier for a group of articles disposed in side by side relationship and forming a rectilinear arrangement of at least two rows of articles, the carrier comprising generally parallel top and bottom walls interconnected by spaced side walls, one of the parallel walls being of composite construction and including a pair of lap panels foldably joined respectively to corresponding edges of the side walls, a medial keel panel foldably joined to one of the lap panels along the edge thereof remote from the associated side wall, at least one retaining notch formed in the medial keel panel, and an insert disposed transverse to the medial keel panel and adapted to form an interlocked relation with the retaining notch, the end edges of the insert being disposed respectively adjacent the side walls.

9 Claims, 3 Drawing Figures

ARTICLE CARRIER

Article carriers are known in which separation between the articles at the points of contact is accomplished by means of various types of inserts. One such insert is disclosed in U.S. Pat. No. 3,715,029, granted Feb. 6, 1973 and owned by the assignee of this invention. In this patent an insert is provided which can be bodily moved at random to a limited degree and still provide proper article separation.

According to this invention a wraparound carrier for a group of articles disposed in side by side relationship and forming a rectilinear arrangement of at least two rows of articles is provided and comprises generally top and bottom walls interconnected by spaced side walls to form a tubular structure, one of the parallel walls being of composite construction and including a pair of lap panels foldably joined respectively to corresponding edges of the side walls, a medial keel panel foldably joined to one of the lap panels along the edge thereof remote from the associated one of the side walls, at least one retaining notch formed in the medial keel panel, and a separate insert formed from a blank which is independent of the blank from which the tubular structure is formed and which is disposed transverse to the medial keel panel and adapted to form an interlocked relation with the retaining notch, the end edges of the insert being disposed respectively adjacent the side walls.

Figure 1:
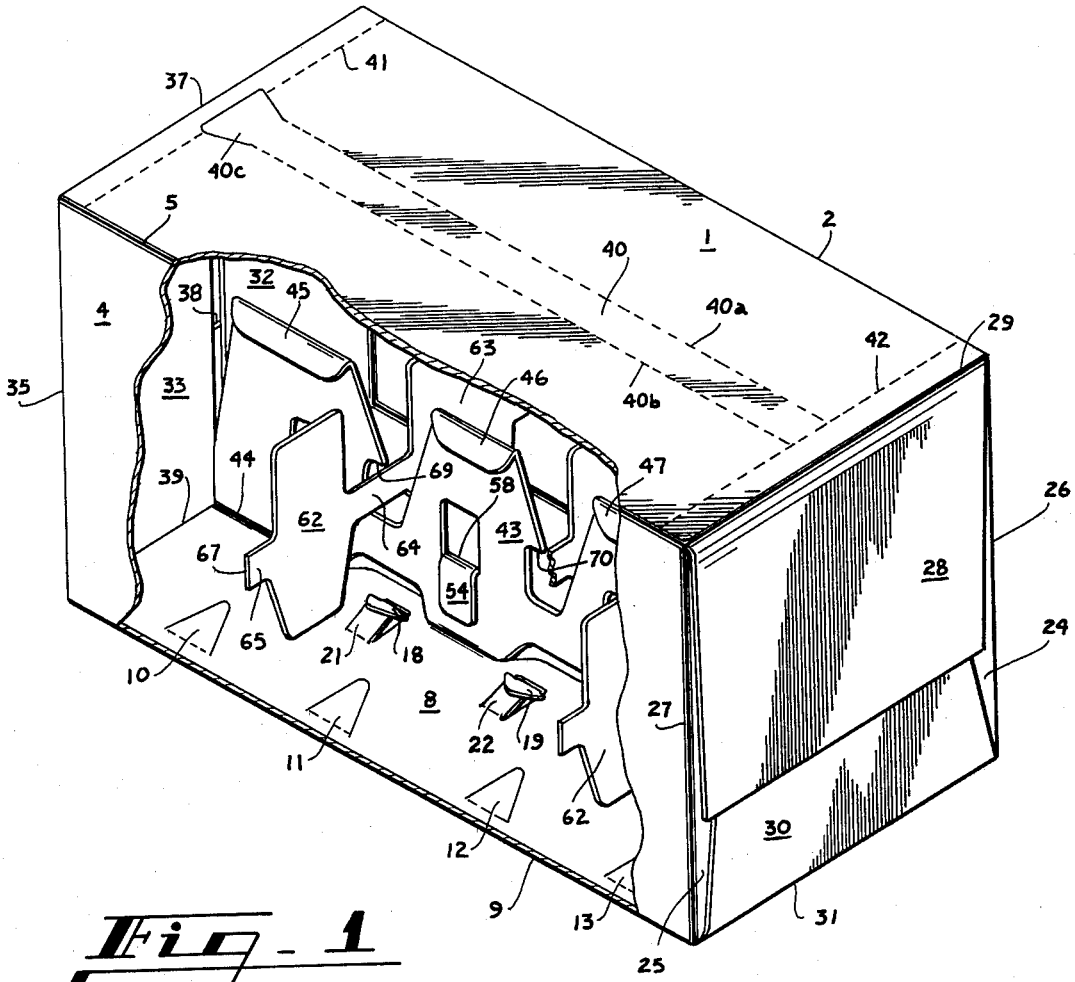
Figure 2:
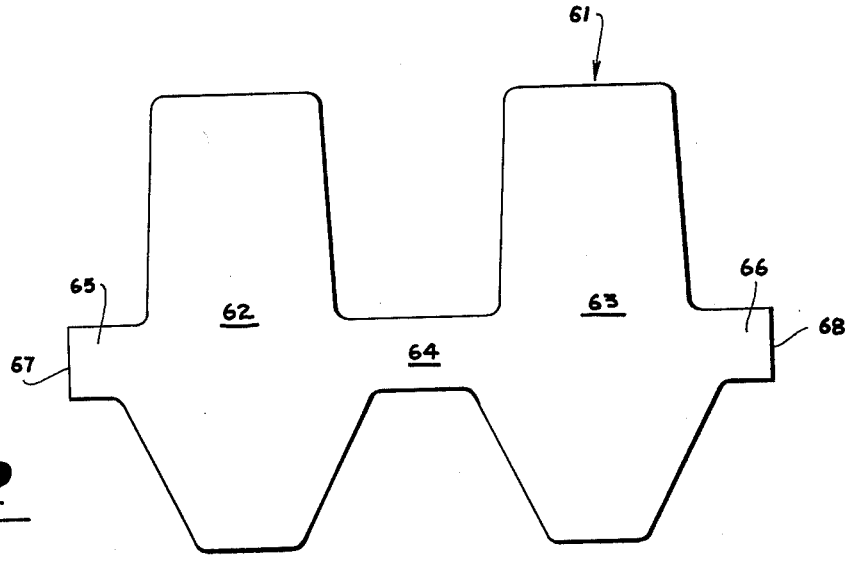
Figure 3:
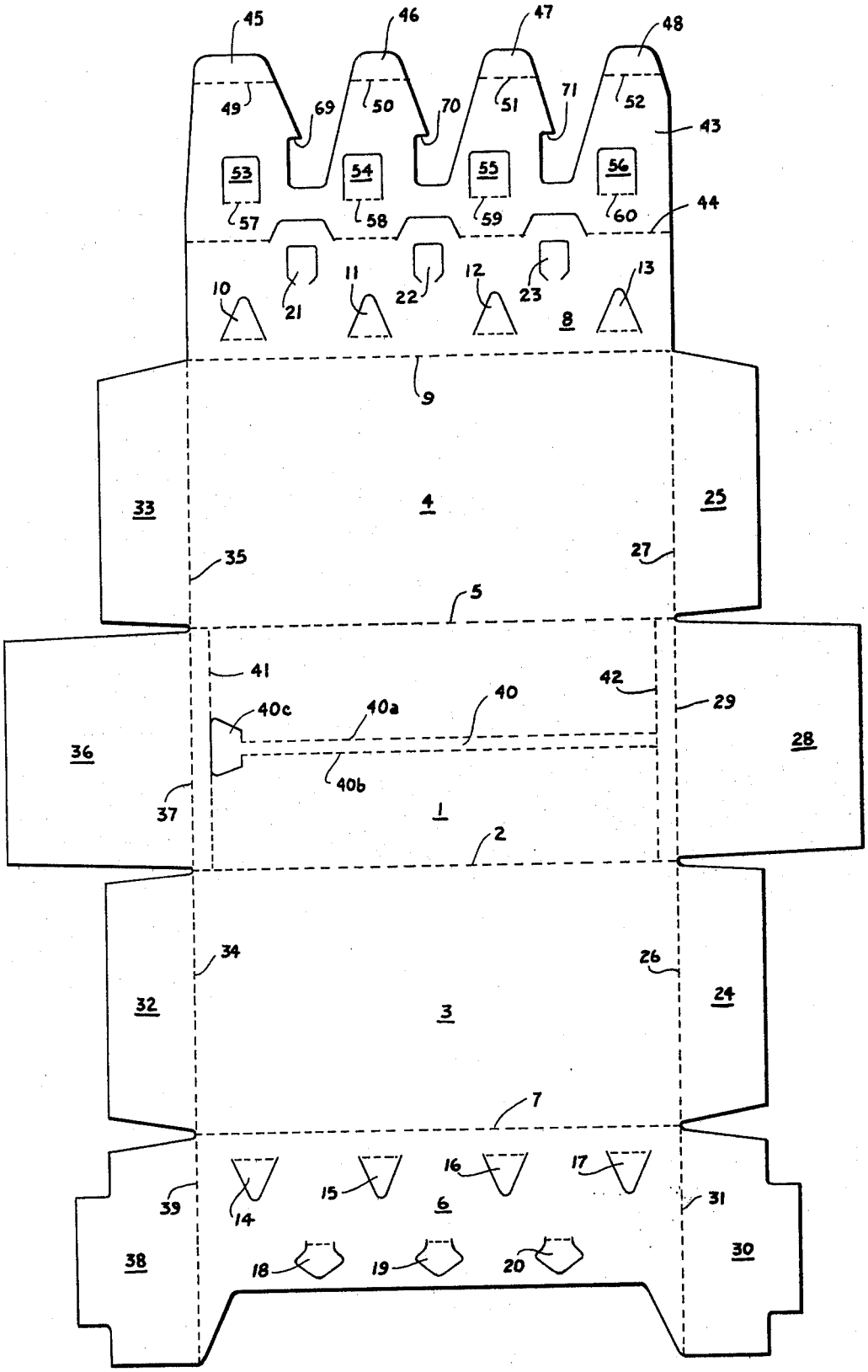

For a better understanding of the invention reference may be had to the following detailed description taken in conjunction with the accompanying drawings in which FIG. 1 is an isometric view of a complete and set up carrier constructed according to this invention;

FIG. 2 is a plan view of an insert constructed according to this invention; and in which FIG. 3 is a plan view of a blank which is manipulated through various stages to form the completed carrier shown in FIG. 1.

In the drawings and with particular reference to FIG. 3, the numeral 1 designates a top wall of the carrier to the side edge 2 of which side wall 3 is foldably joined. Side wall 4 is foldably joined to top wall 1 along fold line 5. Lap panel 6 is foldably joined to the bottom edge of side wall 3 along fold line 7 while lap panel 8 is foldably joined to the bottom edge of side wall 4 along fold line 9.

A plurality of tightening apertures 10, 11, 12 and 13 are formed in lap panel 8 while similar tightening apertures 14, 15, 16 and 17 are formed in lap panel 6. When the blank as shown in FIG. 3 is disposed about a group of articles, appropriate machine elements enter the tightening apertures 10-13 and simultaneously corresponding machine elements enter the tightening apertures 14-17. Subsequently the two groups of tightening elements move transversely inward to impart a tightening action to lap panel 6 and lap panel 8. Once the blank is tightened about the articles, it is secured by means of locking tabs 18, 19 and 20 which are respectively driven by machine elements into apertures defined by retaining tabs 21, 22 and 23.

End closure means is provided and, at one end of the carrier, includes end flaps 24 and 25 which are foldably joined by side walls 3 and 4 respectively along fold lines 26 and 27. In addition end flap 28 is foldably joined to top wall 1 along fold line 29 and similarly end flap 30 is foldably joined to lap panel 6 along fold line 31. In like manner end closure means is provided at the other end of the carrier in the form of end flaps 32 and 33 which are foldably joined respectively to side walls 3 and 4 along fold lines 34 and 35. Also end flap 36 is foldably joined to top wall 1 along fold line 37 and flap 38 is foldably joined to lap panel 6 along fold line 39.

For the purpose of providing convenient opening means for the carrier, tear strip 40 is formed in top wall 1 and is defined by tear lines 40a and 40b and is provided with a pull tab 40c. In order to conveniently fold back portions of top wall 1 after tear strip 40 has been removed, perforated score lines 41 and 42 are provided.

Medial article separation is provided by means of medial keel panel 43 which is foldably joined to lap panel 8 along interrupted fold line 44. If double thickness medial article separation is desired, cushioning tabs 45, 46, 47 and 48 are provided and are foldably joined respectively to medial keel panel 43 along fold lines 49, 50, 51 and 52. In order to provide double thickness article separation about the lower portions of the articles, cushioning tabs 53, 54, 55 and 56 are struck from medial keel panel 43 and are foldably joined thereto along fold lines 57, 58, 59 and 60 respectively.

For the purpose of providing proper transverse article separation, an insert such as shown in FIG. 2 is utilized and is generally designated by the numeral 61. Insert 61 includes a pair of article separation panels 62 and 63 which are interconnected by means of panel connecting strip 64. In order to prevent insert 61 from rotational or transverse movement when placed between four articles, positioning tabs 65 and 66 are disposed at the outer side edges of article separation panels 62 and 63 respectively. In addition positioning tabs 65 and 66 are provided respectively with abutment edges 67 and 68 which are spaced apart by a distance approximating the width of the top and bottom walls and are thus effective to prevent transverse bodily movement of the insert and also tend to prevent up and down movement of one article separation panel such as 62 relative to the other article separation panel such as 63 due to abutting engagement between the abutment edges 67 and 68 and the associated side walls 4 and 3 respectively. In the completed carrier, inserts 61 are anchored against upward movement when positioned in an interlocked relation with retaining notches 69, 70 and 71 which are formed in medial keel panel 43.

In order to set up the carrier according to this invention, inserts 61 are initially placed transversely of the carrier and between groups composed of four bottles. The blank is then tightened around the articles to be packaged and simultaneously medial keel panel 43 is inserted between the two rows of bottles whereby an interlocked relationship is formed between inserts 61 and the respective retaining notches 69, 70 and 71. The blank is then locked into position by means of locking tabs 18, 19 and 20 together with retaining tabs 21, 22 and 23 as discussed above. Following this end flaps 24, 25, 32 and 33 are folded inwardly. End flaps 30 and 38 are then folded upwardly and subsequently end flaps 28 and 36 are folded downwardly to occupy the positions as shown in FIG. 1 which represents the completed and set up carrier constructed according to this invention.

When fully set up, the carrier as shown in FIG. 1 provides full article separation at all points of article contact. In addition inserts 61 are held firmly in place by means of their associated retaining notch and thereby not allowed to slip upwardly as the articles are jostled about during transit. In addition inserts 61 are prevented from transverse or rotational movement because, as best shown in FIG. 1, abutment edge 67 is disposed immediately adjacent and in tight-fitting contact with side wall 3. Likewise, abutment edge 68 is disposed immediately adjacent side wall 4. Therefore by this invention inserts 61 are prevented from movement which causes them to slip out of position and thereby eliminate proper article separation.

To meet railroad regulations, the cushioning tabs 45–48 and 53–56 may be folded into flat face contacting relation with medial keel panel 43 as the package is being formed and the inserts may be formed of double thickness material.

While the carrier as shown in the drawings depicts a carrier suitable for packaging a plurality of eight articles, this invention is quite suitable for use in a package having even multiples of articles of four or more. In addition by utilizing an insert, as shown for example in FIG. 2, economy of material is achieved by the nesting of the inserts during the manufacturing process.

The embodiments of the invention in which an exclusive property or privilege is claimed are defined as follows:

1. A wraparound type carrier for a group of articles disposed in side by side relationship and forming a rectilinear arrangement of at least two rows of articles, said carrier comprising generally parallel top and bottom walls interconnected by spaced side walls to form a tubular structure, one of said parallel walls being of composite construction and including a pair of lap panels foldably joined respectively to corresponding edges of said side walls, a medial keel panel foldably joined to one of said lap panels along the edge thereof remote from the associated one of said side walls, at least one retaining notch formed in said medial keel panel, an insert disposed transverse to said medial keel panel and adapted to form an interlocked relation with said retaining notch, a portion of said medial keel panel being cutaway from the upper edge thereof to a point below said retaining notch to allow entry of said insert into said interlocked relation, and the end edges of said insert being disposed respectively adjacent said side walls.

2. A carrier according to claim 1 wherein said insert comprises a pair of article separation panels interconnected by a panel connecting strip and wherein said retaining notch engages said panel connecting strip.

3. A carrier according to claim 2 wherein a pair of positioning tabs are formed respectively on the ends of said insert and wherein abutment edges are formed on said positioning tabs remote from said article separation panels.

4. A carrier according to claim 3 wherein said abutment edges are spaced apart by a distance approximating the width of said top and bottom walls.

5. A carrier according to claim 1 wherein a tear strip is formed in said top wall.

6. A carrier according to claim 1 wherein end closure means is disposed at each end of the carrier to form a fully enclosed carrier.

7. A carrier according to claim 1 wherein a plurality of retaining notches are formed in said medial keel panel and wherein a plurality of inserts are disposed transverse to said medial keel panel and adapted to form an interlocked relation respectively with said plurality of retaining notches.

8. A wraparound type carrier for a group of articles disposed in side by side relationship and forming a rectilinear arrangement of at least two rows of articles, said carrier comprising generally parallel top and bottom walls interconnected by spaced side walls to form a tubular structure, one of said parallel walls being of composite construction and including a pair of lap panels foldably joined respectively to corresponding edges of said side walls, a medial keel panel foldably joined to one of said lap panels along the edge thereof remote from the associated one of said side walls, at least one retaining notch formed in said medial keel panel, an insert disposed transverse to said medial keel panel and adapted to form an interlocked relation with said retaining notch, a portion of said medial keel panel being cutaway from the upper edge thereof to a point below said retaining notch to allow entry of said insert into said interlocked relation, a first cushioning tab foldably joined to the top edge of said medial keel panel and disposed in flat face contacting relation therewith, and a second cushioning tab foldably joined to said medial keel panel intermediate the top and bottom edges thereof and disposed in flat face contacting relation therewith.

9. A wraparound type carrier for a group of articles disposed in side by side relationship and forming a rectilinear arrangement of at least two rows of articles, said carrier comprising generally parallel top and bottom walls interconnected by spaced side walls to form a tubular structure, one of said parallel walls being of composite construction and including a pair of lap panels foldably joined respectively to corresponding edges of said side walls, a medial keel panel foldably joined to one of said lap panels along the edge thereof remote from the associated one of said side walls, at least one retaining notch formed in said medial keel panel, an insert disposed transverse to said medial keel panel and adapted to form an interlocked relation with said retaining notch, a portion of said medial keel panel being cutaway from the upper edge thereof to a point below said retaining notch to allow entry of said insert into said interlocked relation, said insert comprising a pair of article separation panels interconnected by a panel connecting strip, said retaining notch adapted to engage said panel connecting strip, a pair of positioning tabs formed respectively on the ends of said insert, abutment edges formed on said positioning tabs remote from said article separation panels, and said abutment edges disposed respectively adjacent said side walls.

* * * * *